United States Patent [19]

Yubakami et al.

[11] Patent Number: 4,472,490

[45] Date of Patent: Sep. 18, 1984

[54] IMAGE FORMING PARTICLES

[75] Inventors: Keiichi Yubakami, Neyagawa; Yuji Takashima, Nishinomiya, both of Japan

[73] Assignee: Matsushita Electric Industrial Co., Ltd., Kadoma, Japan

[21] Appl. No.: 504,247

[22] Filed: Jun. 17, 1983

Related U.S. Application Data

[63] Continuation of Ser. No. 297,170, Aug. 28, 1981, abandoned.

[30] Foreign Application Priority Data

Sep. 3, 1980 [JP] Japan ..... 55-122612

[51] Int. Cl.[3] ..... G03G 9/08

[52] U.S. Cl. ..... 430/45; 430/97; 430/109; 430/111

[58] Field of Search ..... 430/45, 97, 109, 111

[56] References Cited

U.S. PATENT DOCUMENTS

| | | | |
|---|---|---|---|
| 2,965,573 | 12/1960 | Gundlach | 430/111 |
| 3,234,017 | 2/1966 | Heyl | 430/97 |
| 4,145,300 | 3/1979 | Hendriks | 430/109 |
| 4,262,078 | 4/1981 | Ishida et al. | 430/109 |

*Primary Examiner*—John E. Kittle
*Assistant Examiner*—John L. Goodrow
*Attorney, Agent, or Firm*—Wenderoth, Lind & Ponack

[57] ABSTRACT

The disclosure is directed to light-transmitting image forming particles each containing at least a colorless subliming dye which develops color through reaction with a color developing agent, and also a coloring agent, and moreover, having at least a pair of parallel faces. When applied to a particular image forming process as disclosed, the particles can provide color images with an expanded latitude and a superior color purity, while, by bevelling or planing-off the edges defining the parallel faces, exposure amount may be reduced as compared with particles without such bevelling.

6 Claims, 13 Drawing Figures

IMAGE FORMING PARTICLES

This application is a continuation of now abandoned U.S. patent application Ser. No. 297,170, filed Aug. 28, 1981, now abandoned.

The present invention generally relates to light-transmitting image forming particles and more particularly, to image forming particles for use in an image forming process in which light-transmitting particles having a color separation or decomposition function and containing a subliming dye which develops color through reaction with a color developer or color developing agent, are caused to electrostatically adhere, in one layer, on an electrically charged photoconductive support or carrier member for image exposure through said particles so as to obtain particle images by removing, from said support member, the particles whose electrostatic attraction with respect to the support member is weakened or those which are released or separated from said support member.

Conventionally, spherical particles have been considered preferable as light-transmitting particles for use in the image forming process of the above described type. However, there has been a disadvantage such that the spherical particles tend to cause fogging, with the result that color purity thereof is undesirably low in the color images to be obtained.

Figure 1:
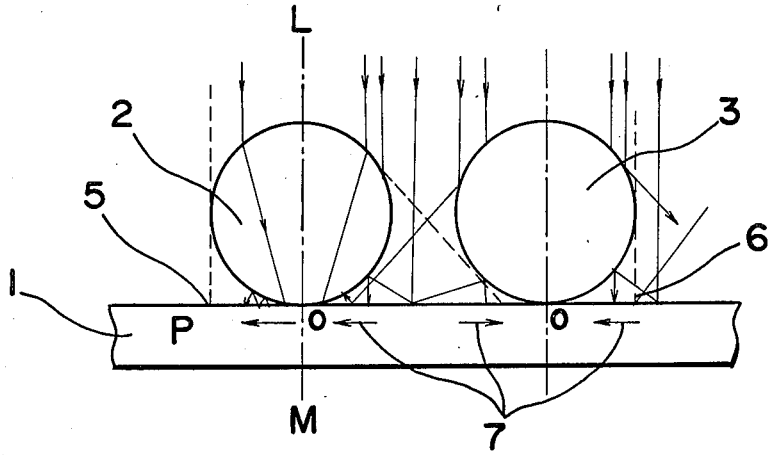
Fig. 1 PRIOR ART

FIG. 1 shows light paths, in the form of a model, in a case where the spherical light-transmitting particles are caused to electrostatically adhere, in one layer, on a photoconductive support member 1 thereby to effect image-exposures. In FIG. 1, the particle 2 permitted the rays of light to pass therethrough, while the particle 3 did not allow the rays of light to pass therethrough.

The rays of light directed onto the particle 2 are focused thereby to be projected onto the surface of the support member. However, the rays of light directed onto the particle 3 are not projected onto the surface of the support member corresponding to said particle 3. The electric charge on the support member 1 is subjected to light-attenuation only in the light-projected portions.

Figure 2A:
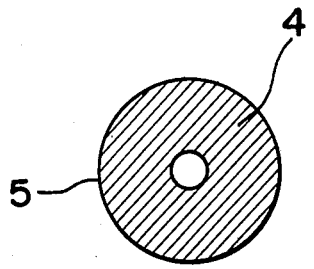
Figure 2A:
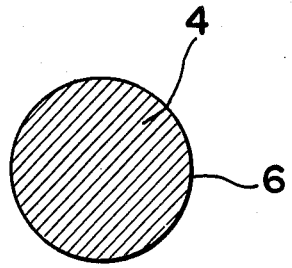

Accordingly, considering an ideal condition, after the image exposure, the ranges of electric charge remaining on the surface of the support member 1 with respect to the particles 2, 3 are shown with hatched portion 4 in FIGS. 2(A) and 2(A)′ respectively. The profile portions of the projection planes of the particles 2 and 3 are designated at 5 and 6 in FIG. 2.

Figure 2B:
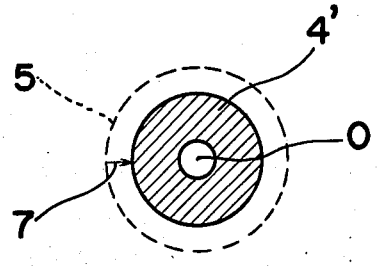
Figure 2B:
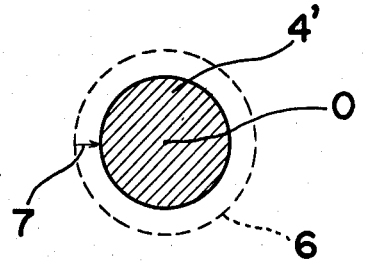

However, the rays of light through the image exposures are irregularly reflected or scattered on the surfaces of the particles and on the surface of the support member 1. Since the particles are in point contact with the support member, the irregularly reflected light or scattered light enters the projection planes of the particles. Therefore, the electric charge on the surface of the support member 1 is eroded in the directions of arrows 7 towards the centers 0 from the profile portions 5 and 6 of the projection planes of the particles 2 and 3. Both particles 2 and 3 are subjected to erosion in the similar manner. The ranges of the electric charge remaining on the surface of the support member 1 after the image exposures in an exposure wherein the particles 2 and 3 begin to effect the colorseparation will be as shown in the hatched portion 4′ in FIGS. 2(B) and 2(B)′. In an exposure amount wherein the color separation of the particles is over, through an increase in the exposure amount, the focused transmitting light is irregularly reflected or scattered on the surface of the support member 1 and on the surfaces of the particles 2 as shown at the right side P from the central line LM of the particle 2 of FIG. 1. The electric-charge on the surface of the support member 1 is eroded, in the direction of an arrow 8 toward the profile portion 5 from the center 0 of the projection plane of the particle 2, due to the irregularly reflected light or the scattered light. Meanwhile, as the exposure amount increases, the erosion, along the direction of the above-described arrow 7, of the electric charge on the support member 1 corresponding to the particles 2 and 3 also proceeds. The range 4′ of the residual electric charge of FIG. 2(B) is eroded, along the directions of arrows 7 and 8 and, into the state as shown by the hatched portion 4″ in FIG. 2(C). In the above case, the erosion along the directions of the arrows 7 and 8 is almost the same in speed. Accordingly, the difference in the residual electric charge amount on the surface of the support member 1, corresponding to the particle 2 and the particle 3 is small over the exposure width from the beginning of the color separation of the particle to the end thereof, while the exposure amount width which maximizes the difference of this residual electric charge amount is also narrow. Namely, the latitude is narrow. Similarly, at the exposure amount wherein the particle starts the color separation, the particle 2 is difficult to be developed, and there are disadvantages such that fogging tends to take place on the surface of the support member corresponding to the white portion of an original, and owing to the fact that the color purity of the color image is low, in the exposure amount where the particle terminates its color separation, the particle 3 is likely to be removed during the development, with consequent reduction in the image density. Namely, the conventional spherical particles have drawbacks such that the latitude thereof is narrow, and fogging is likely to take place, with a low color purity as described hereinabove.

Accordingly, an essential object of the present invention is to provide improved image forming particles in which the latitude is advantageously expanded, with a simultaneous improvement in the color purity.

Another important object of the present invention is to provide improved image forming particles of the above described type which are simple in structure and stable in performance, and can be readily manufactured on a large scale at low cost.

In accomplishing these and other objects, according to one preferred embodiment of the present invention, there are provided improved image forming particles for use in a color image forming process which includes the steps of causing the image forming particles transparent to light and containing at least a colorless subliming dye which develops color through reaction with a color developing agent and also a coloring agent, to electrostatically adhere in one layer, on a photoconductive support member, effecting image exposure through the particles so as to remove the particles weakened in electrostatic attraction with respect to the support member or released from the support member for obtaining particle images, and heating the particle images and an image receptor closely contacting each other so as to obtain color developed images of the dye on the image receptor. The image forming particles each comprising the color subliming dye and coloring agent, are provided with at least a pair of parallel faces formed thereon.

By the construction of the present invention described above, improved image forming particles having an expanded latitude and an improved color purity have been advantageously presented, with substantial elimination of disadvantages inherent in the conventional image forming particles of this kind.

Figure 3:
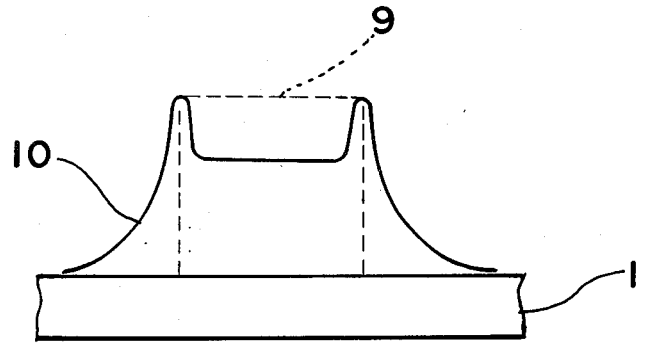
Figure 2C:
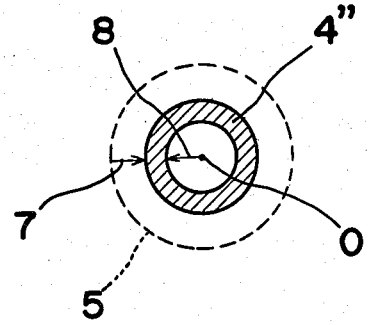
Figure 2C:
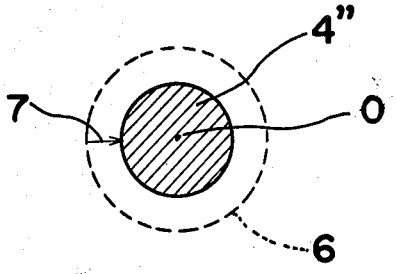
Figure 5:
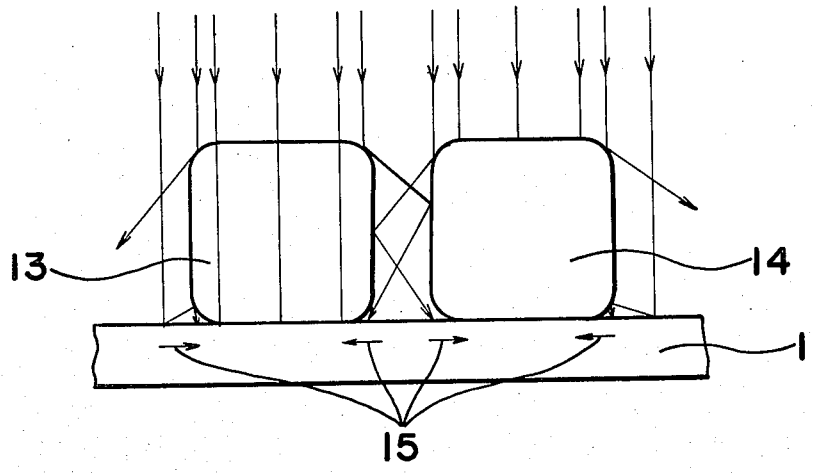
Figure 6:
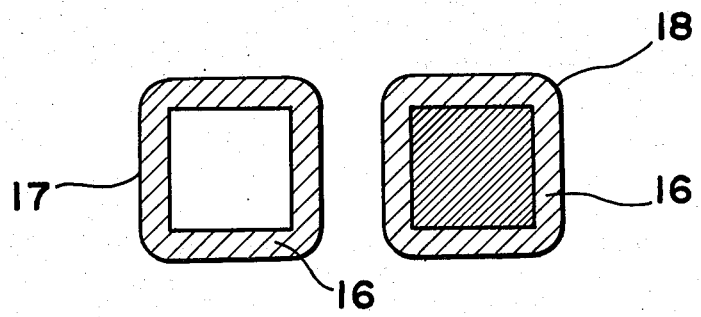
Figure 6:
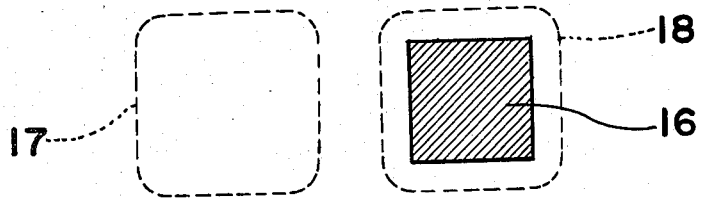

These and other objects and features of the present invention will become apparent from the following description taken in conjunction with the preferred embodiment thereof with reference to the accompanying drawings, in which:

FIG. 1 is a schematic diagram showing light paths during image exposure in a case where conventional image forming particles are used (already referred to);

FIGS. 2(A) to 2(C)' are schematic top plan views showing the range of residual electric-charge in portions corresponding to the particles, on a support member after the image exposure (already referred to);

FIG. 3 is a schematic diagram showing strength distribution of electrostatic attraction, to which a cubic particle electrostatically adhering onto a charged support member is subjected;

FIGS. 4(A) and 4(B) are schematic top plan views showing the range of residual electric-charge on the portions corresponding to the particles, on the support member after the image exposure;

FIG. 5 is a schematic diagram showing light paths during the image exposure in a case where particles of the present invention are employed; and FIGS. 6(A) and 6(B) are schematic diagram showing the range of residual electric charge in the portions corresponding to the particles, on the support member after the image exposure.

Before the description of the present invention proceeds, it is to be noted that like portions are designated by like reference numerals throughout several views of the accompanying drawings.

In the first place, it is to be noted that the image forming particle of the present invention is required to have at least a pair of parallel faces.

Accordingly, the present inventors have made investigations into light transmitting particles whose shapes are made into cubic configurations as described hereinbelow.

Referring now to the drawings, generally, when cubic particle 9 as referred to above is caused to electrostatically adhere onto a support member 1 whose surface is uniformly charged, the strength distribution of the electrostatic adhering force becomes as shown by a curve 10 of FIG. 3. When such cubic particle 9 is used, the rays of light which have been transmitted through the particle are projected onto the support member without being focused. However, the light is not transmitted through the profile portion of the particle. Accordingly, the range of the electric charge remaining on the surfaces, corresponding to the light-transmitted particle and the non-light-transmitted particle, of the support member becomes, respectively, as shown in the solid-line surrounded portion 11 of FIG. 4(A), and the hatched portion 12 of FIG. 4(B). Moreover, since the particles are in face contact with the support member, residual electric charge is not readily eroded due to influences of the irregularly reflected light and the scattered light as noticed in the spherical particles. Accordingly, in the cubic particles, the range in which the electric charge at the portion 12 in FIG. 4(B) is eroded, is extremely narrow even if the residual electric charge of the portion 11 in FIG. 4(A) is eroded through an increase in the exposure amount. Furthermore, since the support member is in face contact with the particle which has not allowed the rays of the light to pass through, the electrostatic adherence force remains strong, thus resulting in an expanded latitude, with an improved color purity of image.

Figure 4:
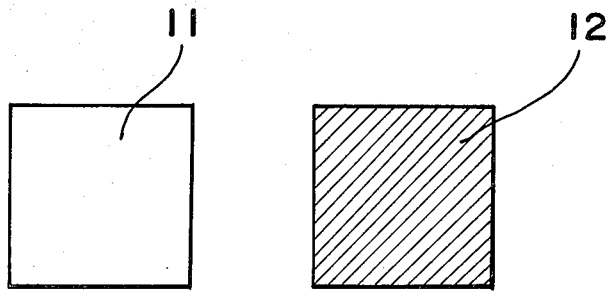

As described hereinabove, it has been confirmed by the present inventors, that the cubic particle provides an expanded latitude, with a simultaneous improvement in the color purity of the resultant images. However, the solid-line surrounded portion 11 in FIG. 4(A) corresponds to the position of the peak of the strength distribution 10 of the electrostatic adherence force shown in FIG. 3. Therefore, the difference in the electrostatic adherence force between the light-transmitted particle and the non-light-transmitted particle with respect to the support member is large as compared with the case of the spherical particles, while the electrostatic adherence force, due to the electric charge, of the solid-line surrounded portion 11 in FIG. 4(A) is also strong. As described earlier, according to the cubic particle, the residual electric charge is difficult to be eroded due to the influences of the irregularly reflected light and the scattered light. Thus, in order to erode the electric charge at the solid-line surrounded portion 11 in Fig. 4 (A), the exposure amount twice or more as much is required as compared with the spherical particle of the same size.

In connection with the above, as a result of a series of experiments, the present inventors have found that, by employing a particle having at least a pair of parallel planes and further, by bevelling or planing-off edges forming said planes, expansion of latitude and improvement of color purity in the resultant images to approximately the same extent as in the cubic particles, may be achieved at an exposure amount of about 80% to 50% that for the cubic particle of the similar size.

Hereinbelow, the principle of the present invention will be described with reference to the cubic particles whose edges are bevelled or planed-off (referred to as bevelled particles hereinbelow).

FIG. 5 shows light paths during image exposure in a case where the bevelled particles have been caused to electrostatically adhere in one layer, on the photoconductive support member 1. The light-transmitted particle and the non-light-transmitted particle are designated at 13 and 14, respectively.

The rays of light projected onto the particle 13 are transmitted, without being focused, through the flat portion of the particle surface. Meanwhile, the light is difficult to be transmitted through the bevelled or planed-off portion as compared with the flat portion of the particle. However, the electric charge on surface, corresponding to the bevelled portions, of the support member 1 is eroded in the directions of the arrows 15 towards the centers from the profile portions of the particle due to the irregular reflection and the scattering on the surfaces of the particles and the surface of the support member as in the spherical particles. Accordingly, at the exposure amount wherein the particles start the color separation, the range of the residual electric charge on the surface, corresponding to the particles 13 and 14, of the support member 1 becomes as shown in the hatched portion 16 in FIG. 6(A). The profile portions of the projection planes of the particles 13 and 14 are respectively designated at 17 and 18. Meanwhile, in the hatched portion 16, a portion where the spaces between the slant lines are narrow, represents the larger residual electric-charge amount.

Near the profile portion of the projection plane of the particle, the residual electric-charge amount on the support member 1 is reduced due to influences of the above-described irregular reflection and scattering. Moreover, since these portions are bevelled or planed-off and gaps exist between the surface of the support member and the surface of the particle 13, the electrostatic attraction of the portions is considerably weakened. Thus, even in the state of FIG. 6(A), the particle 13 is removed during the developing operation. Additionally, the flat portion of the particle 14 is in face contact with the support member 1, and at such portion, the electric charge remains, as shown in FIG. 6(A), without being eroded. Accordingly, even in the exposure amount wherein the particles start the color separation, the color which is free from fogging is obtained, thus resulting in improved color purity.

Furthermore, as the exposure amount increases, the range of the electric charge remaining on the surface, corresponding to the particle 13 and the particle 14, of the support member becomes as shown in FIG. 6(B). Namely, as the exposure amount increases, the residual electric charge at the profile portion 17 is attenuated with respect to the particle 13, while the residual electric charge near the profile portion 18 is attenuated with respect to the particle 14. The electric charge remains as it is on the portion corresponding to the flat portion. Accordingly, the particle 14 is not removed even in the developing operation, thus resulting in an expanded latitude.

The materials for the particles which may be employed in the present invention will be described hereinafter.

The particle is generally composed of resin. For such resin, for example, thermoplastic resins such as polyvinyl alcohol, acrylic resin or the like, thermosetting resins such as melamine resin, phenol resin or the like, or transparent resins such as styrenebutadiene copolymer, gelatin or the like may be employed.

The color separating function is imparted to the particle by addition of coloring agent such as dye, pigment or the like to the above-described resin. As the representative coloring agents, there may be mentioned acid dyes such as C.I. Acid Red 6, 14, 18, 42 or the like, or organic pigments such as C.I. Pigment Red 17, 48, 81 or the like for red light transmitting use. Meanwhile, there may be employed acid dyes such as C.I. Acid Green 9, 27, 40, 43 or the like, metallized dyes such as Aizen Spilon Green C-GH (Hodogaya Chemical Co., Ltd.) or the like or organic pigments such as C.I. Pigment Green 2, 7 or the like for green light transmitting use. Similarly, there are also available oil dyes such as C.I. Solvent Blue 48, 49 or the like, direct dyes such as C.I. Direct Blue 86 or the like, acid dyes such as C.I. Acid Blue 23, 40, 62, 83, 120 or the like, or organic pigments such as C.I. Pigment Blue 15, etc., for blue light transmitting use. Additionally, other desired spectral characteristics may be obtained with single coloring agent or through mixing of a plurality of coloring agents when necessary.

Furthermore, a color developing function may be added by the addition of a colorless subliming dye.

For the colorless subliming dye there may be employed any dye as long as it is colorless or light-colored under the normal condition, and is sublimed once heated, and develops a color through reaction with a developer, for example, organic acid such as tartaric acid, trichloracetic acid, fumaric acid, maleic acid, ascorbic acid, phenylacetic acid, etc., inorganic acid such as acid clay, etc. phenalic substances such as bisphenol A (4,4'-isopropylidene phenol), etc. Meanwhile, the colorless subliming dye does not give influences on the color separation function of the particle under the normal condition. Accordingly, it is possible to add the coloring agent, which gives the particle a color separation function, together with the colorless subliming dye, which color forms a color complementary to the coloring agent. However, needless to say an image receptor is required to have the above-described color developer.

For the representative examples of the colorless subliming dyes, there may be raised 3,7-bis-diethylamino-10-tricholoroacetyl-phenoxazine, 4-(1,3,3,5-tetramethyl-indolino) methyl-7-(N-methyl-N-phenyl)amino-1',3',3',5'-tetramethyl-spiro [2H-1-benzopyran-2,2'-[2'H]-indole], N-(1,2-dimethyl-3-yl)-methylidene-2,4-dimethoxy aniline, etc.

The image forming particle of the present invention is required to be electrostatically adhering, into one layer, on the photoconductive support member. For such purpose, it is desirable that at least the surface of the particle has an electrical conductivity. Therefore, when a non-conductive resin is used, the conductive treatment is applied onto the surface. Even after the conductive treatment, the particle of the invention should be transparent to light, without any influence on the color separation. For the conductive material as described above, copper iodide, polyelectrolyte or the like may be adapted. Moreover, the specific resistance of the particle surface should preferably be within the range of 10 through $10^{10}\Omega\cdot$cm. Furthermore, when a plurality of kinds of particles which are different in color separating function are mixed for use, it is desirable that the difference in the respective specific resistance values be arranged within one digit.

The shape of the image forming particle in accordance with the present invention is desired to be cubic, but may be rectangular (hereinafter referred to as a hexahedral particle) because of its expanded latitude as described earlier. Similarly, each of the edges may be bevelled or planed-off as described earlier, to reduce the exposure amount (hereinafter referred to as a bevelled particle). The shape of the bevelling and the range are not particularly restricted. As a method of manufacturing the particle, which is based on a parallelepiped, as a standard shape as described hereinabove, following methods may be employed, although they may differ according to the particle material. In the first place, cubic or rectangular particles are obtained by a normal forming method, a method of forming a particle material into a square pillar shape and then performing a cutting operation, a method of forming the particle material into a sheet shape and then performing a punching operation or a cutting operation, or a photogravure printing method or the like. As the bevelling method, there are a method of performing the bevelling operation in advance during the forming, a method of subjecting to a ball mill the particles obtained by either of the above-described methods, a thermal treating method, a cutting method, etc. Alternatively, after the spherical particles have been manufactured by a normal method, each of the particles may be formed into a flat-face particle through application of pressures or by a cutting operation (hereinafter referred to as a flat particle).

The size of the image forming particle of the present invention should preferably be within the range of 5 through 100 μm.

It is to be noted that the image forming particles of the present invention may be used for the similar image forming process even if the particles are of one type in color. Needless to say, monochromatic particle images are obtained in this case.

Hereinbelow, EXAMPLES are inserted for the purpose of illustrating the present invention, without any intention of limiting the scope thereof.

EXAMPLE 1

Solutions of red, green, blue purple were prepared by the following recipe.

| Substances | parts by weight |
|---|---|
| (1) Red Solution | |
| Melamine: Sumitex Resin M-3 (name used in trade and manufactured by the Sumitomo Chemical Co., Ltd.) | 100 |
| Curing accelerator: Sumitex Accelerator EPX (the same as above) | 8 |
| Coloring dye: Methyl Orange | 8 |
| Coloring dye: Aizen Rose bengal B (name used in trade for C.I. Acid Red 94 and manufactured by Hodogaya Chemical Co., Ltd.) | 2 |
| Water | 100 |
| (2) Green Solution | |
| Melamine resin bonding agent: | 100 |
| Curing accelerator: | 8 |
| Coloring dye: Suminol levelling yellow NR (name used in trade for C.I. Acid Yellow 19 and manufactured by the Sumitomo Chemical Co., Ltd.) | 10 |
| Coloring dye: Kayacion Green A-4G (name used in trade and manufactured by Nippon Chemical Co., Ltd.) | 7 |
| Water | 100 |
| (3) Blue Purple Solution | |
| Melamine resin bonding agent: | 100 |
| Curing accelerator: | 8 |
| Coloring dye: Acid Violet 6B (name used in trade for C.I. Acid Violet 49 and manufactured by Hodogaya Chemical Co., Ltd.) | 1.2 |
| Water | 100 |

The solutions of the above items (1) through (3) were poured, respectively, into cubic molds, whose sides were, respectively, 80 μm, and heated at 150° C. for one minute so as to be cured into cubic particles. Colorless subliming dye solutions were applied in a fluid state, respectively, onto these particles by the following recipe.

(1) Red particle

Colorless subliming dye to be developed into cyanic color. A solution 50 parts by weight composed of 3,7-bis-diethylamino-10-trichloroacetyl-phenoxazine 10 parts by weight, bonding agent ethylcellulose 1 part by weight and solvent dichloroethane 89 parts by weight is applied in a fluid state onto the red particles 100 parts by weight.

(2) Green Particle

Colorless subliming dye to be developed into magenta color. A solution 15 parts by weight composed of 4-(5-chloro-1,3,3-trimethyl-indolino)methyl-7-(N-methyl- N-phenyl)amino-5'-chloro-1',3',3'-trimethyl-spiro[2H-1- benzopyran-(2 H)-indole]10 parts by weight, ethylcellulose 1 part by weight and dichloroethane 89 parts by weight is applied onto the green particles 100 parts by weight.

(3) Blue Purple Particle

Colorless subliming dye to be developed into yellow color. A solution 15 parts by weight composed of N-(1,2-dimethyl-3-yl)methylidene-2,4-dimethoxy aniline 10 parts by weight, ethylcellulose 1 part by weight and dichloroethane 89 parts by weight is applied, in a fluid state, onto the blue purple particles 100 parts by weight.

Subsequently, the coloring particles 100 parts by weight obtained in the manner as described hereinabove were added to a solution, which was prepared by addition of water 90 parts by weight to ECR-34 (manufactured by Dou Chemical Co., Ltd.) 10 parts by weight of polyelectrolyte fourth class ammonium salt, with a sufficient mixing thereof. The materials thus obtained were separately spray-dried and treated for electrical conduction. The specific resistance of the particle was approximately $10^8\Omega\cdot$cm.

The image forming particles separately obtained in such a manner as described hereinabove were blended respectively in equal amount to obtain image forming particles for color application.

As the photoconductive support member, the normal panchromatic zinc oxide sensitive-plate was used.

As an image forming method, the sensitive plate was charged in darkness to negative polarity by a corona charger applied to −6 through −7 KV, and then, the image forming particles for color application were scattered, in darkness, on the sensitive plate. The sensitive plate was subjected to a slight vibration to remove the excessively adhering particles, with the result that the particles were caused to electrostatically adhere, in one layer, on the sensitive plate member. Then, the color transmitting original was subjected to image exposure for about ten seconds with the use of a 500 W tungsten lamp. After the image exposure, upon subjection of the sensitive plate to a slight vibration, the image forming particles, which were reduced in the electrostatic attraction or released with respect to the sensitive plate due to the exposure, were dropped, with the result that the color-separated particle images were provided on the sensitive plate.

Subsequently, white light was projected onto the entire surface of the sensitive plate so as to subject the electrostatic latent images remaining upon the sensitive plate to attenuation. Thereafter, the clay layer face was brought into close contact with the sensitive plate and the voltage of +10 through 200 V was applied from the reverse face of the clay paper to electrostatically transfer the particles on the clay paper. The transfer factor was approximately 100%. Then, the electrostatically transferred clay paper was heated to 180° rough 250° C. for subliming of the colorless subliming dye so as to form a color in the clay layer, with the particles being removed by a cleaning brush. As a result, positive-positive color images true to the original were reproduced on the clay paper.

Moreover, the color density was the same in grade even when the exposure time was rendered to be 75 seconds.

EXAMPLE 2

The cubic particles were formed by a method as described in EXAMPLE 1. Thereafter, the particles were treated with a ball mill for about thirty minutes so as to subject the respective edges to bevelling. The bevelled portion became spherical, about 7 μm in diameter.

Then, in the similar manner as in EXAMPLE 1, the colorless subliming dye was applied, in a fluid state, onto the particles. The resultant particles were then treated for electrical conduction, whereby the image forming particles for color use were obtained. The image forming method as described in EXAMPLE 1 was applied to the particles thus obtained, with the result that the positive-positive color image faithful to the original was reproduced. The color density remained unchanged over the exposure time of about 7 through 55 seconds.

EXAMPLE 3

Gelatin filters of red, green, blue (Kodak. Wratten gelatin filter No. 25, No. 58, No. 47B) were cut, respectively, into rectangular particles each being 70μm×50μm×10μm. The colorless subliming dye was applied, in a fluid state, onto the particles by the same method as in EXAMPLE 1, with simultaneous treatment for electrical conduction and thus, the image forming particles for color application were obtained.

Upon application of the image forming method as described in EXAMPLE 1 to the above particles, positive-positive color images faithful to the original were reproduced. The color density remained unchanged over the exposure time of about 5 through 40 seconds.

EXAMPLE 4

Solutions of red, green, blue purple were prepared according to the following recipe. The pigment used was finely ground so as to have particle diameters of 0.02 through 0.1 μm, respectively.

| | parts by weight |
|---|---|
| (1) Red Solution | |
| Resin bonding agent: Styrene butadiene copolymer (hereinafter referred to as SBR) DANBOND (name used in trade and manufactured by NIPPON ZEON Co., Ltd.) | 100 |
| Coloring pigment: C.I. Pigment Red 17 | 1.2 |
| Colloidal Silica: SNOWTEX ST-20 (name used in trade and manufactured by Nissan Chemical Industries, Ltd.) | 100 |
| Colorless subliming dye (cyanic color development): 3,7-bis-diethylamino-10-trichloroacetyl-phenoxazine | 2 |
| (2) Green Solution | |
| SBR | 100 |
| Coloring pigment: C.I. Pigment Green 2 | 1 |
| ST-20 | 100 |
| Colorless subliming dye (magenta color development): 4-(1,3,3,5-tetramethyl-indolino)methyl-7-(N—methyl-N—phenyl)amino-1',3',3',5'-tetramethyl-spiro[2H—1-benzopyran-2,2'-[2'H]—indole] | 2 |
| (3) Blue Purple Solution | |
| SBR | 100 |
| Coloring pigment: C.I. Pigment Violet 3 | 1.3 |
| ST-20 | 100 |
| Colorless subliming dye (yellow color development): N—(1,2-dimethyl-3-yl)-methylidene-2,4-dimethoxy aniline | 2 |

The above-described three types of solution were separately mixed for scattering by a ball mill for one hour, and subsequently, was granulated separately by a spray drying method, so that spherical particles each being of 3 through 60 μm in diameter were obtained.

Then, copper iodide solution 200 parts by weight of the following recipe was applied, in a fluid state, onto the particles 100 parts by weight obtained in the manner as described hereinabove. Thereafter, they were classified into particles each being of 20 through 37 μm in diameter. The specific resistance thereof was approximately $10^{5}\Omega\cdot cm$, *respectively.*

| Copper Iodide Solution Recipe | |
|---|---|
| Copper iodide | 20 parts by weight |
| Polyvinyl acetate | 2 parts by weight |
| Acetonitrile | 100 parts by weight |

Then, the particles were caused to separately adhere electrostatically, in one layer, on the charged releasing paper, and the paper was inserted between the iron plates spaced at 18 μm. Upon subsequent application of a pressure of 5 kg per $cm^2$ thereto, the particles were flattened.

The flattened particles obtained in the manner as described above were mixed respectively in equal amount to manufacture the image forming particles for color application.

The image forming method as described in EXAMPLE 1 was applied to the image forming particles for color thus obtained. The positive-positive color images faithful to the original were reproduced. The color density remained unchanged over the exposure time of 3 through 20 seconds.

Upon application of the same image forming method to the spherical particles before flattening for comparison, the color concentration remained unchanged over the exposure time of 2.7 through 5 seconds.

The rate of fogging was 2 through 1% in the spherical particles, while it was 0.5% or less in the case of flattened particles.

As is clear from the foregoing description, when applied to the image forming method in which the light transmitting particles are caused to electrostatically adhere in one layer, onto the photoconductive support member and after image exposure, the particles weakened in the electrostatic attraction with respect to the support member or those released from the support member, are removed for obtaining particle images on said support member, the image forming particles according to the present invention have particular effects as follows.

More specifically, the image forming particles according to the present invention are held in face contact with the support member at flat portions, while light transmitted through such flat portions is not condensed. Therefore, the electric charge on the surface of the support member held in contact with the particles through which light is transmitted, is subjected to attenuation. On the other hand, the particles which did not allow light to be transmitted therethrough, are not readily affected by the irregular reflection and scattering of light on the surfaces of the support member and the particles, and thus, the effect for expanding the latitude may be obtained. Moreover, since the difference in electrostatic attractions between the particles which allow light to pass therethrough and those which do not permit light to pass therethrough is significantly large, color purity is advantageously improved, without formation of the undesirable fogging.

Furthermore, by employing the bevelled particles or flat particles according to the present invention, the electrical charge at the profile portion of the particle projection plane is attenuated owing to the irregular reflection and scattering on the surfaces of the support member and particles, and therefore, clear and definite particle images may be obtained by a less exposure amount than in the hexahedron particles of the same particle size. Accordingly, since the power consumption of a light source for the image exposure is small, with a simplified optical system, it is possible to provide, for example, an inexpensive copying apparatus at a reduced power consumption. Moreover, owing to the fact that the access time is advantageously shortened, the particles of the present invention may be applied to high speed copying apparatuses.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. Image forming particles for use in a color image forming process which comprises the steps of causing the image forming particles transparent to light and containing at least a colorless subliming dye which develops color through reaction with a color developing agent and also a coloring agent, to electrostatically adhere in one layer, on a photoconductive support member, effecting image exposure through said particles so as to remove the particles weakened in electrostatic attraction with respect to said support member or released from said support member for obtaining particle images, and heating said particle images and an image receptor closely contacting each other so as to obtain color developed images of said dye on said image receptor, said image forming particles each comprising said color subliming dye and said coloring agent, and at least having a pair of parallel faces formed thereon.

2. Image forming particles as claimed in claim 1, wherein edges defining said parallel faces are bevelled.

3. Image forming particles as claimed in claim 1 or claim 2, further having electrical conductivity.

4. Image forming particles as claimed in claim 1, wherein the color of said coloring agent and the color developed by said colorless subliming dye through reaction thereof with said color developing agent are, respectively, complementary colors.

5. A process of forming color images which comprises the steps of employing image forming particles transparent to light and containing at least a colorless subliming dye which develops color through reaction with a color developing agent and also a coloring agent, causing said image forming particles to electrostatically adhere in one layer, on a photoconductive support member, effecting image exposure through said particles so as to remove the particles weakened in electrostatic attraction with respect to said support member or released from said support member for obtaining particle images, and heating said particle images and an image receptor closely containing each other so as to obtain color developed images of said dye on said image receptor, said image forming particles being provided with at least a pair of parallel faces formed thereon.

6. The process according to claim 5, wherein edges defining said parallel faces are bevelled.

* * * * *